United States Patent [19]

Yamauchi et al.

[11] Patent Number: 4,980,606

[45] Date of Patent: Dec. 25, 1990

[54] ELECTRON BEAM FOCUSING DEVICE FOR USE IN A CRT

[75] Inventors: Masaaki Yamauchi, Togane; Yasuo Tanaka, Ichihara, both of Japan

[73] Assignees: Hitachi, Ltd., Tokyo; Hitachi Device Engineering Co., Ltd., Chiba, both of Japan

[21] Appl. No.: 243,850

[22] Filed: Sep. 13, 1988

[30] Foreign Application Priority Data

Sep. 18, 1987 [JP] Japan ..... 62-232254

[51] Int. Cl.[5] ..... H01J 29/46; H01J 29/56

[52] U.S. Cl. ..... 315/14; 313/450

[58] Field of Search ..... 315/14, 15; 313/450, 313/414

[56] References Cited

U.S. PATENT DOCUMENTS

| | | | |
|---|---|---|---|
| 3,950,667 | 4/1976 | De Jong et al. | 313/450 |
| 4,124,540 | 11/1978 | Foreman et al. | 313/450 |
| 4,143,298 | 3/1979 | Bing et al. | 313/450 |
| 4,243,911 | 1/1981 | Winarsky et al. | 313/414 |
| 4,531,075 | 7/1985 | Stone | 313/414 |

FOREIGN PATENT DOCUMENTS 57192051 5/1956 Japan .

*Primary Examiner*—Theodore M. Blum

*Attorney, Agent, or Firm*—Antonelli, Terry, Stout & Kraus

[57] ABSTRACT

An electron beam focusing device for use in a cathode ray tube (CRT) including a first and a second conductor film each formed on the inner surface of a neck portion of the CRT, which are spaced apart from each other by a predetermined distance, and a resistive conductor film which connects the first and second conductor films with each other. The first conductor film is located before the second conductor film in a beam travelling direction. The additional conductor film has a higher resistivity than that of the first and second conductor films. The first conductor film is set at a higher potential than the second conductor film. A dark current flowing from a high potential side through the first conductor film, the resistive conductor film and the second conductor film produces a voltage drop across the resistive conductor film so that the surface potential of the resistive conductor film is stabilized, thus forming an electrostatic lens with a stabilized electric field.

7 Claims, 2 Drawing Sheets

ELECTRON BEAM FOCUSING DEVICE FOR USE IN A CRT

BACKGROUND OF THE INVENTION

The present invention relates to an electron beam focusing device for use in a cathode ray tube (CRT), and more particularly to an electron beam focusing device that can provide a large diameter electrostatic lens.

Electron beams in a CRT are inclined to spread immediately before the focusing point of a screen. This is called the divergence of beams. Therefor, in order to improve the focusing characteristic of a CRT, it is necessary to converge the electron beams with a larger deflection angle which can be provided by increasing the diameter of an electron lens formed by an electron gun.

To this end, it has been proposed to provide an electron lens using the inner diameter of a neck tube as disclosed, for example, in JP-A-57-192051 (U) filed on May 29, 1981. FIG. 2 shows a section of the conventional CRT including such an electron lens. As shown in FIG. 2, a first conductor film 3 and a second conductor film 4 spaced by a predetermined distance l are formed on the inner surface of the neck tube 2 of a CRT 1; the first conductor film 3 is connected with an anode button (not shown). An electron gun 10 is constituted by a cathode electrode 5, a first grid electrode ($G_1$) 6, a second grid electrode ($G_2$) 7, a third grid electrode ($G_3$) 8, and a contact member 9 for contact. The second conductor film 4 is connected with the third grid electrode (G ) 8 through the contact member 9. The third grid electrode 8 is connected with a pin 13 of a stem 12 through a connector 11, and the pin 13 is connected with a focusing power supply 14.

A high voltage is applied to the first conductor film 3 through the anode button, whereas a predetermined voltage is applied to the second conductor film 4 from the focusing power supply 14 though the pin 13, the connector 11, the $G_3$ electrode 8 and the conductor member 9. An electrostatic lens 101 is formed by the first conductor film 3 and the second conductor film 4 spaced apart from each other by a predetermined distance l. The diameter thereof is so large as to be substantially equal to the inner diameter of the neck tube 2.

The prior art mentioned above has the following two serious problems

The first problem is: since there is a great potential difference (about 20 KV) between the first conductor film 3 and the second conductor film 4, electric field concentration will occur at the ends of the films if the distance l is relatively short, thereby causing discharge.

The second problem is as follows. The surface potential at the inner surface of the neck tube 2 corresponding to the distance l, which is made of an insulator, is always unstable and not uniform due to dirt on the inner surface and the secondary electron multiplication phenomenon by "stray emission" at the insulator portion. Thus, the electric field of the electrostatic lens 101 formed by the first conductor film 3 and the second conductor film 4 is also not uniform, thereby providing undesirable astigmatism. Accordingly, beam spots having various forms other than an axis-symmetrical form will be provided. Also, the diameter of the beam spots can not be satisfactorily converged. Further, the non-uniform electric field mentioned above provides a secular change in the average locus of the electron beams so that image positions are also changed on the screen.

The above two problems are related with each other. Namely, although the blocking voltage capability or withstand voltage can be enhanced if the distance l is increased, the electric field instability will be further amplified, thereby making it impossible to actually use the electrostatic lens.

SUMMARY OF THE INVENTION

An object of the present invention is to provide an electron beam focusing device for use in a CRT which overcomes the problems in the prior art and provides an electrostatic lens having enhanced voltage blocking capability and a stabilized electric field.

To achieve the above object, in accordance with the present invention, there is provided an electron beam focusing device in which formed between a first low resistivity conductor film and a second low resistivity conductor film is an additional resitive conductor film having a higher resistivity than the first and second low resistivity conductor films so as to connect them with each other. The first and second low resistivity conductor films, the additional resistive conductor film and the focusing voltage adjustment resistor serve as a series of resistors inserted between a positive electrode of a high voltage source, which supplies a positive high voltage through the anode button to the first conductor film, and a negative electrode thereof. Thus, a dark current flows from the positive electrode of the high voltage source to the negative electrode thereof through the first conductor film, the additional resistive conductor film, the second conductor film and further a resistor for adjusting the focus characteristic. The surface potential of the resistive conductor film has a certain potential gradient due to the voltage drop provided when the dark current flows. In this case, the surface potential, because of not being influenced from the dirt of the surface and the absence of stray emission, is very stable. An electrostatic lens with a stabilized electric field is thus formed. This electrostatic lens does not advantageously provide a secular change. Further, the distance between the first conductor film and the second conductor film can be made long since the surface potential is stable, thus greatly improving the voltage blocking capability. The improved voltage blocking capability makes unnecessary one working step called a nocking step which is a step in the process of fabricating the CRT where a voltage several times as large as the operation voltage is applied to bake and scatter dirt and dust, thereby stabilizing the voltage blocking capability. Further, the surface potential of the second conductor film, which contributes to adjust the focusing characteristic can be set at a predetermined value by varying the resistance of the focusing characteristic adjusting resistor to change the dark current and hence produce the resulting voltage drop. An external focusing power supply which was required in the prior art is not required. Thus, in accordance with the present invention, the CRT and a television set including it can be manufactured at very reduced cost.

BRIEF DESCRIPTION OF THE DRAWINGS

Through FIGS. 1 to 5, like reference numerals refer to like elements.

DESCRIPTION OF THE PREFERRED EMBODIMENTS

Figure 1:
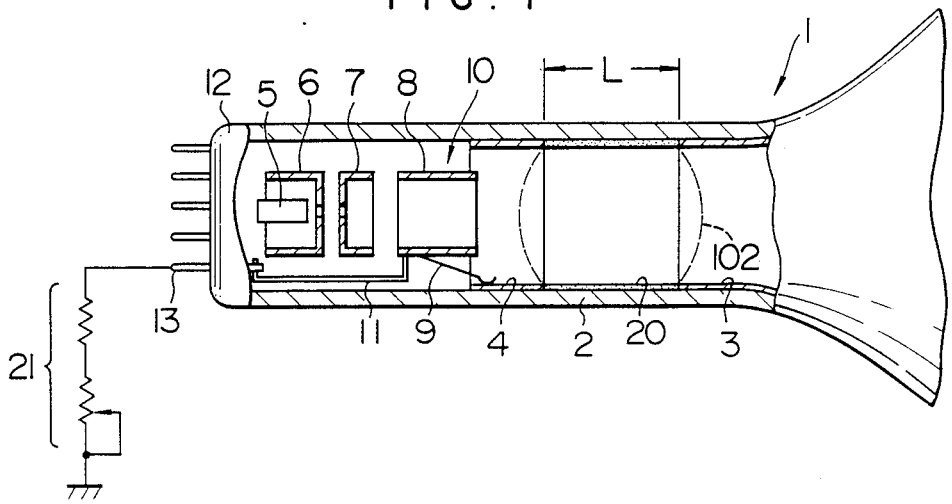
FIG. 1 is a sectional view of the main part of CRT in accordance with one embodiment of the present invention.
Figure 2:
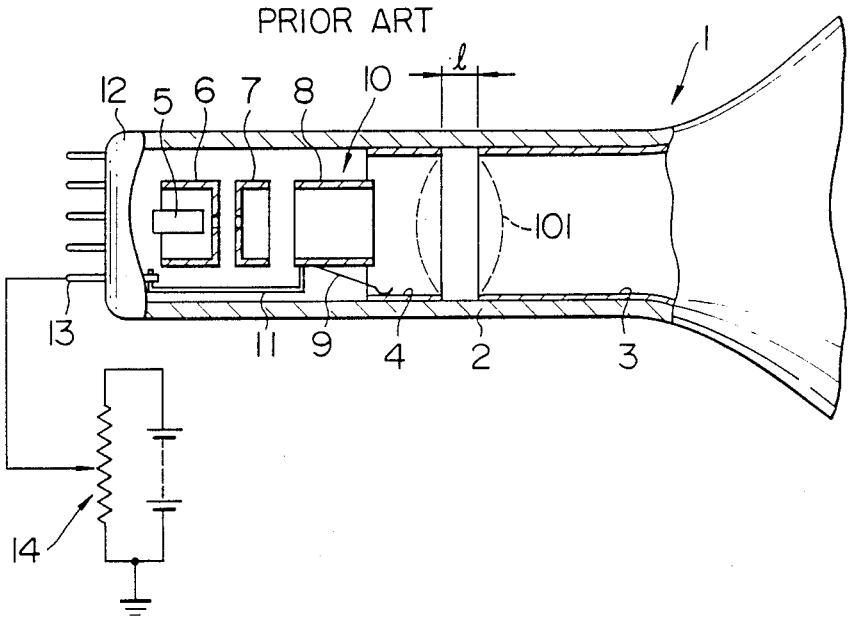
FIG. 2 PRIOR ART
FIG. 2 is a sectional view of the main part of the prior art CRT.

A first embodiment of the present invention will be explained with reference to FIG. 1. As shown in FIG. 1, a first conductor film 3 and a second conductor film 4 spaced therefrom by a predetermined distance L are formed on the inner surface of a neck tube 2 of a CRT 1; the first conductor film 3 is connected with an anode button (not shown). An electron gun 10 is constituted by a cathode electrode 5, a first grid electrode ($G_1$) 6, a second grid electrode ($G_2$) 7, a third grid electrode ($G_3$) 8, and a contact member 9 for contact. The second conductor film 4 is connected with the third grid 1 electrode ($G_3$) through the contact member 9. The third grid electrode 8 is connected with a pin 13 of a stem 12 through a connector 11. The pin 13 is connected with a resistor 21 for focusing voltage adjustment.

A resistive conductor film 20 which has a higher resistivity than that of the first and second conductor films 3 and 4 is formed on the portion corresponding to the distance L between the first and second conductor films 3 and 4 so as to connect them with each other. The resistance of the resistive conductor film 20 is on the order of magnitude of M (mega) Ω.

The first and second conductor films 3 and 4, the resistive conductor film 20 and the focusing voltage adjustment resistor 21 serve as a series of resistors inserted between a positive electrode of a high voltage source, which supplies a positive high voltage through the anode button to the first conductor film 3, and a negative electrode thereof. Thus, a dark current which is decided by the sum of the resistances of these series resistors always flows across these resistors. This dark current produces a large potential difference between the first conductor film 3 and the second conductor film 4 due to the voltage drop across the resistive conductor film 20. Thus, a large diameter electrostatic lens 102 is formed, thereby converging the electron beam into small spots.

In this case, the potential gradient across the resistive conductor film 20 can be easily varied by varying the resistivity of the resistive conductor film 20 so that the strength of the focusing force of electron beams, spherical aberration, etc., which are characteristic of a large diameter lens, can be set with great design freedom. Further, the focusing of electron beams can adjusted by varying the resistance of the focusing voltage adjustment resistor 21 to set the second conductor film 4 at a predetermined potential.

Figure 3:
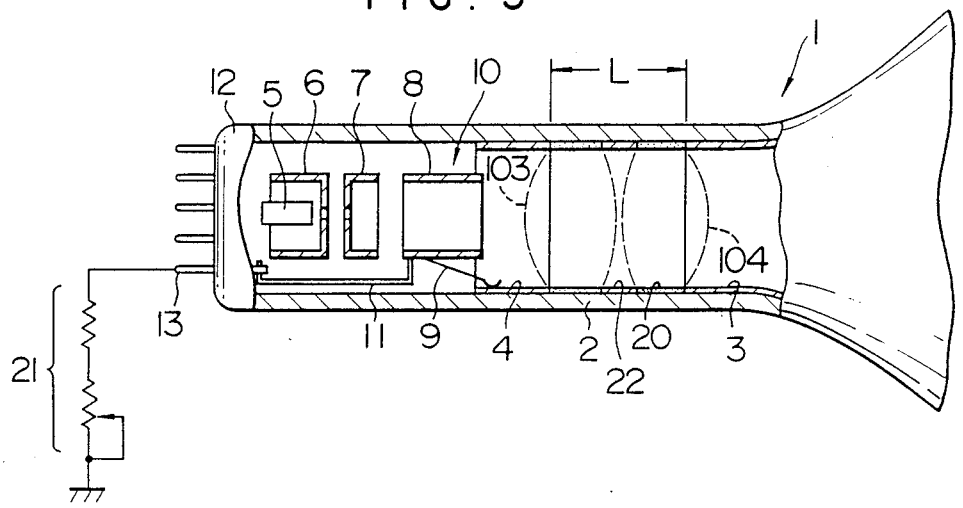
FIG. 3 is a sectional view of the main part of CRT in accordance with another embodiment of the present invention.

Another embodiment of the present invention will be explained with reference to FIG. 3. In this embodiment, as shown in FIG. 3, one or more ring-shaped conductor film 22 having a resistivity approximately equal to those of the first and second conductor films 3 and 4 is formed in the middle of the resistive conductor film 20. Therefore, if one ring shaped conductor film 22 is placed between the first and second conductor films 3 and 4, two electrostatic lenses 103 and 104 are formed; one electrostatic lens 103 is formed between the second conductor film 4 and the ring-shaped conductor film 22 whereas the other electrostatic lens 104 is formed between the ring-shaped conductor film 22 and the first conductor film 3. If N (N: integer) ring-shaped conductor films 22 are provided, (N+1) electrostatic lenses are formed, which provides the same effect as the case where a plurality of thin lenses are stacked, thus improving the spherical aberration of the resultant electrostatic lens. In this case, the performance of the electrostatic lens corresponds to an electrostatic lens with a diameter larger than the neck diameter.

Figure 4:
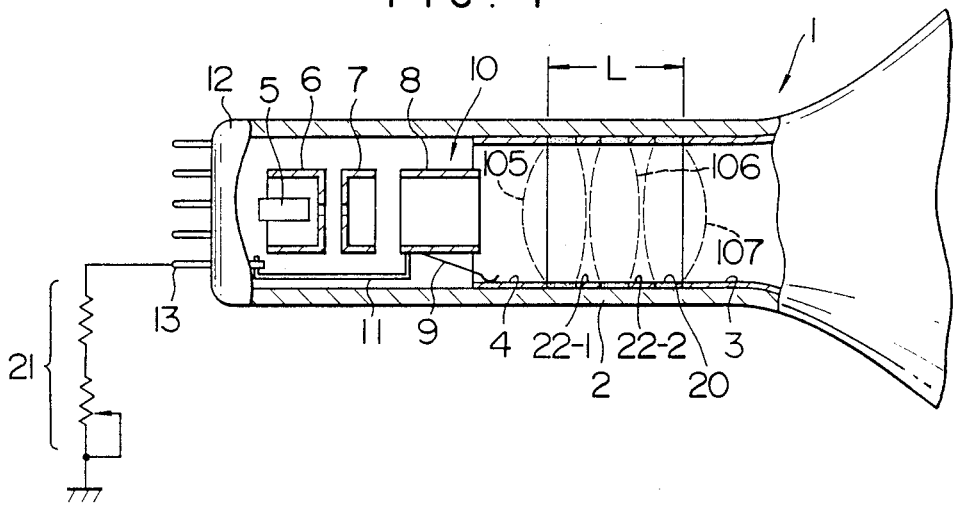
FIG. 4 is a sectional view of the main part of CRT in accordance with still another embodiment of the present invention.

FIG. 4 shows the case where two ring-shaped films 22-1 and 22-2 are provided to form three electrostatic lenses 105, 106 and 107. The conductor film(s) 22 are not necessarily required to be ring shaped, but may be formed in a zig-zag shape or any other several shapes.

Figure 5:
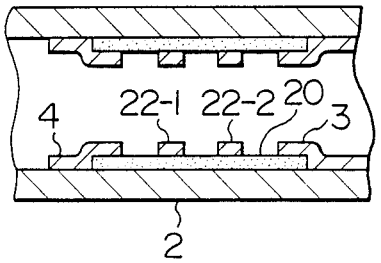
FIG. 5 is a sectional view of a modification of the embodiment of FIG. 4.

Moreover, as shown in FIG. 5, the first and second conductor films 3 and 4 may be partially overlayed on the resistive conductor film 20 together with the conductor film(s) 22.

We claim:

1. An electron beam focusing device for use in a cathode ray tube (CRT) comprising:

a first and a second conductor film each formed in a substantially ring shape having a predetermined width and in contact with an inner surface of said CRT at least inside of a neck portion of the CRT, said first conductor film being located in an electron beam travelling direction before and spaced apart from said second conductor film by a predetermined distance, said first conductor film being at a higher potential than said second conductor film; and a resistive conductor film which connects said first and second conductor films with each other and has a higher resistivity than said first and second conductor films, wherein an electrostatic lens having a diameter as large as an inside diameter of said CRT and having a stabilized electric field is formed.

2. An electron beam focusing device for use in a CRT according to claim 1, wherein at least one additional conductor film in a substantially ring shape having a predetermined width is arranged in the region corresponding to said resistive conductor film so that said additional conductor film and said resistive conductor film are alternately connected with each other in parallel to said first conductor film, said additional conductor film having a resistivity substantially equal to one of said first and second conductor films.

3. An electron beam focusing device for use in a CRT according to claim 1, wherein said first and second conductor films are at least partially overlayed on said resistive conductor film, respectively.

4. An electron beam focusing device for use in a CRT according to claim 2, wherein at least portions of said first and second conductor films and said additional conductor films are overlaid on said resistive conductor film, respectively.

5. An electron beam focusing device for use in a CRT according to claim 1, further comprising adjusting means including a variable resistor means located between a positive electrode of a high voltage source, which supplies a positive high voltage to said first conductor film, and said second conductor film, said adjusting means serving to vary the resistance of said variable resistor means so as to set said conductor film at a predetermined potential, thereby adjusting the focusing of electron beams.

6. An electron beam focusing device according to claim 1, wherein said electrostatic lens has a diameter as large as an inside diameter of said neck portion of said CRT.

7. An electron beam focusing device according to claim 1, further comprising means for adjusting the focus of a plurality of electron beams passing through the electrostatic lens.

* * * * *